US011732634B1

(12) United States Patent
Toriizuka et al.

(10) Patent No.: US 11,732,634 B1
(45) Date of Patent: Aug. 22, 2023

(54) ENGINE

(71) Applicant: KAWASAKI MOTORS, LTD., Hyogo (JP)

(72) Inventors: Ren Toriizuka, Hyogo (JP); Mitsuo Toyoshima, Hyogo (JP)

(73) Assignee: KAWASAKI MOTORS, LTD., Hyogo (JP)

( * ) Notice: Subject to any disclaimer, the term of this patent is extended or adjusted under 35 U.S.C. 154(b) by 0 days.

(21) Appl. No.: 17/824,124

(22) Filed: May 25, 2022

(51) Int. Cl.

| | |
|---|---|
| ***F01P 1/06*** | (2006.01) |
| ***F01P 5/06*** | (2006.01) |
| ***F02F 7/00*** | (2006.01) |
| ***F01P 1/02*** | (2006.01) |

(52) U.S. Cl.
CPC *F01P 1/06* (2013.01); *F01P 1/02* (2013.01); *F01P 5/06* (2013.01); *F02F 7/007* (2013.01); *F01P 2001/023* (2013.01)

(58) Field of Classification Search
CPC ..... F02F 7/007; F01P 1/02; F01P 1/06; F01P 5/06; F01P 2001/023
See application file for complete search history.

(56) References Cited

U.S. PATENT DOCUMENTS 5,689,953 A * 11/1997 Yamashita ..... F01N 3/05 180/68.1
11,041,425 B1 6/2021 Yano
2020/0309062 A1* 10/2020 Kono ..... F02F 7/0082
2022/0106901 A1 4/2022 Toriizuka

FOREIGN PATENT DOCUMENTS

JP S61282666 A * 12/1986
JP 2012163088 A * 8/2012

* cited by examiner

*Primary Examiner* — Kevin A Lathers
(74) *Attorney, Agent, or Firm* — Greenblum & Bernstein, P.L.C.

(57) ABSTRACT

An engine according to the present disclosure includes: a crankcase which supports a crankshaft of the engine; a cylinder which is removably connected to the crankcase and protrudes from the crankcase in a cylinder axis direction; a cooling fan which is attached to the crankshaft and rotates in conjunction with the crankshaft; and a cover which guides cooling air generated by the cooling fan to an outer surface of the cylinder. The cover includes an opening part which allows a portion of the cooling air to flow toward an outer surface of the crankcase.

20 Claims, 8 Drawing Sheets

ENGINE

BACKGROUND OF THE INVENTION

Field of the Invention

The present disclosure relates to an engine which is cooled by cooling air generated by a cooling fan.

Description of Related Art

Some engines have been known in which a cooling fan which is driven in conjunction with a crankshaft and generates cooling air to cool cylinders (For example, U.S. Pat. No. 11,041,425 and US2022/0106901A).

In some engines whose cylinders are cooled by cooling air, there is a need for further lowering engine temperature.

SUMMARY OF THE INVENTION

The present disclosure provides an engine which can have lower temperature in the engine.

The engine according to the present disclosure includes: a crankcase which supports a crankshall of the engine; a cylinder which is connected to the crankcase and protrudes from the crankcase in a cylinder axis direction; a cooling fan which generates cooling air; and a cover which guides the cooling air toward the cylinder. The cover includes a facing wall located adjacent to the crankcase and facing the cylinder. The facing wall includes: an opening part which allows a portion of the cooling air to flow toward an outer surface of the crankcase; and a blocking part which is arranged next to the opening part in a flow direction of the cooling air to prevent the cooling air from flowing out of the cover.

According to this constitution, the blocking part of the facing wall can prevent the cooling air from flowing away from the cylinder, so that the cooling air can be guided toward the cylinder. In addition, since the facing wall includes the opening part defined in an area excluding the blocking part, a portion of the cooling air flows through the opening part toward the outer surface of the crankcase to be used for cooling the crankcase. This makes it possible to suppress temperature rise in the whole engine.

The present disclosure encompasses any combination of at least two features disclosed in the claims and/or the specification and/or the drawings. In particular, any combination of two or more of the appended claims should be equally construed as included within the scope of the present disclosure.

BRIEF DESCRIPTION OF THE DRAWINGS

The present disclosure will be more clearly understood from the following description of preferred embodiments thereof, when taken in conjunction with the accompanying drawings. However, the embodiments and the drawings are given only for the purpose of illustration and explanation, and are not to be taken as limiting the scope of the present disclosure in any way whatsoever, which scope is to be determined by the appended claims. In the accompanying drawings, like reference numerals are used to denote like or corresponding parts throughout the several views:

DESCRIPTION OF THE EMBODIMENTS

Figure 1:
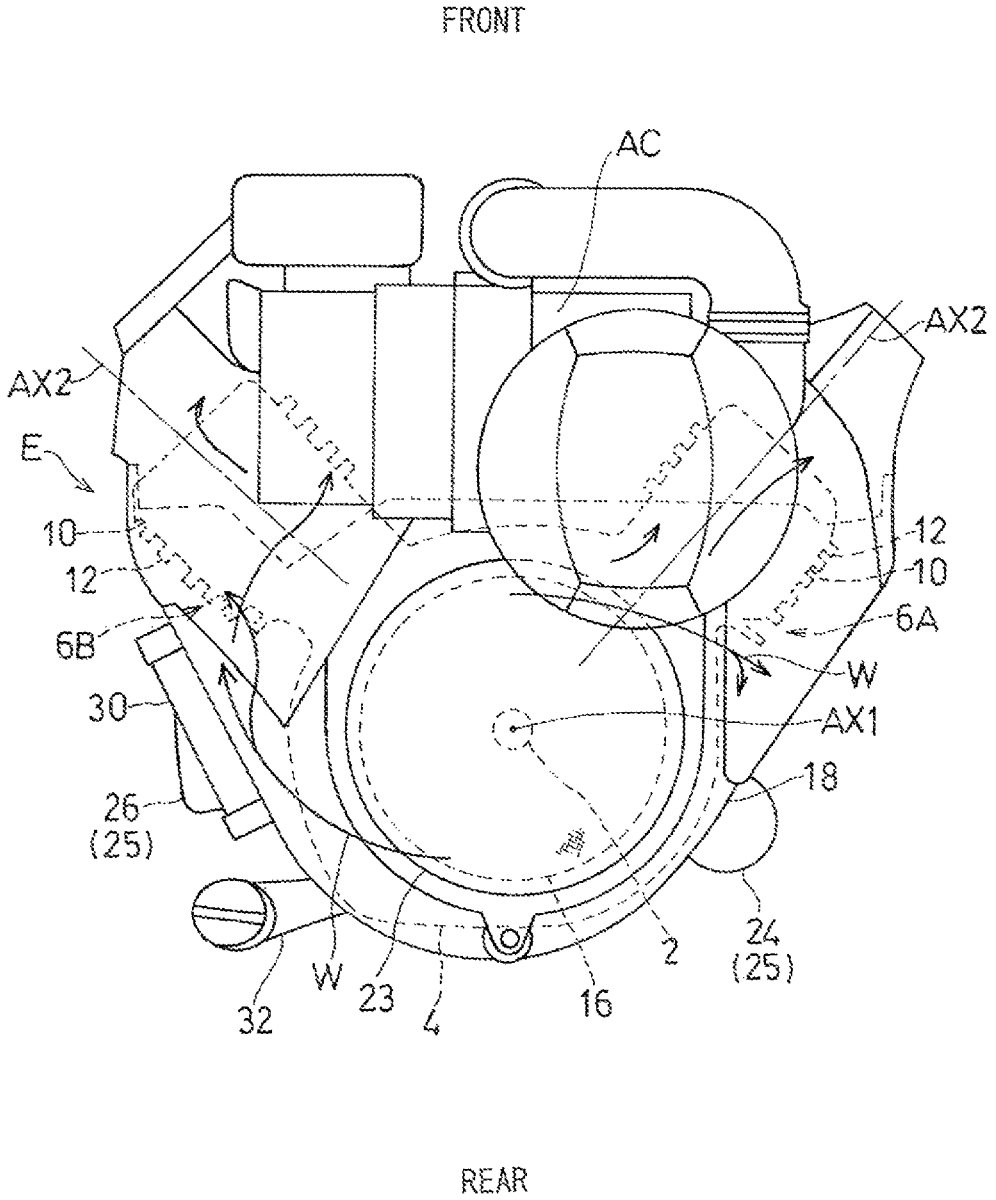
FIG. 1 is a plan view of an engine according to a first embodiment of the present disclosure.

Hereinafter, a preferred embodiment according to the present disclosure will be described with reference to the drawings. FIG. 1 is a plan view of an engine E according to a first embodiment of the present disclosure. The engine E according to the present disclosure is a so-called V-type engine including two cylinders whose cylinder axes widen in a V shape. The engine E according to the present disclosure is a vertical two-cylinder engine which has an axis of a crankshaft, i.e., a rotation axis extending in a vertical direction when the engine operates. The engine E according to the present disclosure is, for example, used as a drive source for a riding lawn mower. In such a case, the engine E is mounted in a lawn mower such that the rotation axis of the engine extends in the vertical direction. The type and intended use of the engine E, however, are not limited to these.

In the following description, a "front" side refers to a side of the V-shaped banks, i.e., a side toward which the V shape widens, and a "rear" side refers to a side opposite to the front side. An up-and-down direction refers to a direction of an axis AX1 of the rotation shaft of the engine, and a widthwise direction refers to a direction perpendicular to the up-and-down direction or vertical direction and a front-to-rear direction.

The engine E according to the present disclosure includes: a crankshaft 2 having the axis AX1 extending in the up-and-down direction when the engine is mounted in a work machine; a crankcase 4 which supports the crankshaft 2; and a pair of first and second cylinders 6A, 6B which protrude from the crankcase 4 in a direction perpendicular to the axial direction AX1. The crankcase 4 defines a housing space which houses a crank web part of the crankshaft 2. In order to define the housing space, the crankcase 4 includes a case main body 4*a* and a case cover 4*b* which closes a lower end portion of the case main body. A power transmission member which transmits power to a work tool such as a lawn mower blade is attached to a lower end portion of the crankshaft 2. An upper end portion of the crankshaft 2 protrudes above the crankcase 4. A later-described cooling fan 16 is attached to the upper end portion of the crankshaft 2.

The first cylinder 6A and the second cylinder 6B are arranged in a symmetrical manner with respect to a center line which passes through the rotation axis AX1 and extends in the front-to-rear direction. An axis of the first cylinder 6A extends away from the center line toward one side in the widthwise direction as it extends away from the rotation axis AX in a radial direction. An axis of the second cylinder 6B extends away from the center line toward the other side in the widthwise direction as it extends away from the rotation axis AX in a radial direction.

Respective base end portions of the cylinders 6A, 6B are connected to the crankcase 4. Each of the cylinders 6A, 6B includes a cylinder head 10 connected to a protruding end portion of that cylinder. The crankcase 4, the cylinders 6A, 6B, and the cylinder heads 10 in the present embodiment are made of an aluminum alloy. The material of these components is not limited to an aluminum alloy. In the following description, the cylinders 6A, 6B include the cylinder heads 10.

As shown in FIG. 1, the cylinder axis AX2 of each cylinder 6 extends in an inclined manner toward an outside in the widthwise direction as it extends away from the rotation axis AX1. The cylinder axes AX2 of the two cylinders 6A, 6B define a V shape which widens frontward. That is, the cylinders 6A, 6B protrudes from the crankcase 4 in respective directions of the cylinder axes AX2. The direction of each cylinder axis AX2 coincides with a horizontal direction and is perpendicular to the axial direction AX1 of the crankshaft 2. In the present embodiment, the first cylinder 6A illustrated on the right side in FIG. 1 is a first cylinder which explodes first, and the second cylinder 6B illustrated on the left side is a second cylinder which explodes subsequently.

Each of the cylinders 6A, 6B has cooling tins 12 on an outer periphery thereof. The cooling fins 12 provide increased surface areas on the cylinders 6A, 6B, as compared with a case where the cylinders do not have the cooling fins 12. This facilitates heat dissipation from the engine E to enhance the cooling effect. A non-illustrated intake port is provided on one side of the cylinder head 10 with respect to the axial direction AX1 of the crankshaft 2 (on an upper side in the present embodiment), and a non-illustrated exhaust port is provided on the other side (on a lower side in the present embodiment). Intake system components such as an air cleaner AC and a non-illustrated throttle body are connected to the intake port, and exhaust system components such as an exhaust pipe and an exhaust muffler are connected to the exhaust port.

Figure 2:
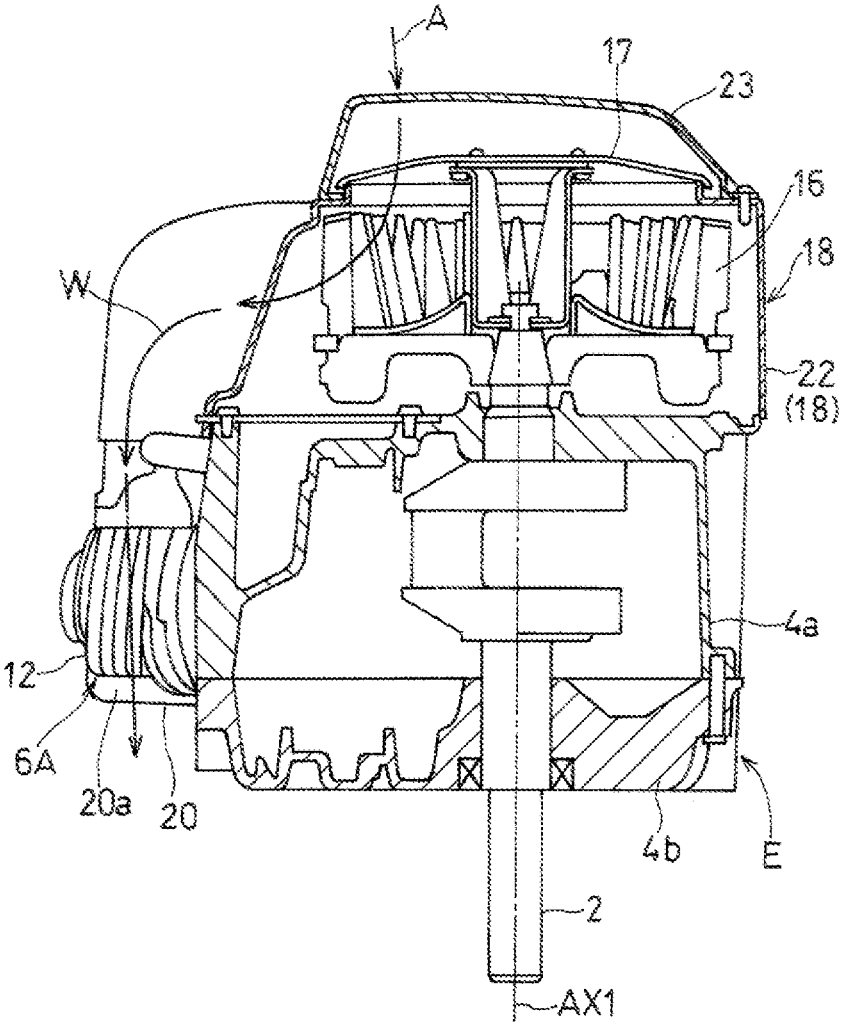
FIG. 2 is a vertical section view of the engine.

As shown in FIG. 2, a cooling fan 16 is attached to the upper end portion of the crankshaft 2. The cooling fan 16 rotates in conjunction with the crankshaft 2. As the cooling fan 16 rotates, ambient air is taken into the engine as cooling air W. The cooling air W generated by the cooling fan 16 comes into contact with the cooling fins 12 of the cylinders 6A, 6B to take heat therefrom. Thus, the cylinders 6A, 6B are cooled. The cooling fan 16 is arranged on one side of the cylinders 6A, 6B with respect to the axial direction AX1 of the crankshaft 2 (on an upper side in the present embodiment). The cooling fan 16 of the present embodiment is a sirocco fan which takes in air around the engine and sends the cooling air W radially outward from the crankshaft 2 in a radial fashion. The cooling fan 16 is not limited to a sirocco fan.

A screen 17 having a disc shape is attached to an upper end of the cooling fan 16. The screen 17 rotates along with the cooling fan 16 to cut foreign objects such as grass clippings which are sucked in due to a suction force of the cooling fan 16.

A fan housing 18 is attached to the crankcase 4 and the cylinders 6. The fan housing 18 is made of, for example, a resin. The material of the fan housing 18, however, is not limited to a resin. The fan housing 18 covers an outer periphery and an upper part of the cooling fan 16, except for an air intake port which faces the upper side of the cooling fan. The tan housing 18 circumferentially guides the cooling air W which are sent radially outward by the cooling fan 16.

Figure 8:
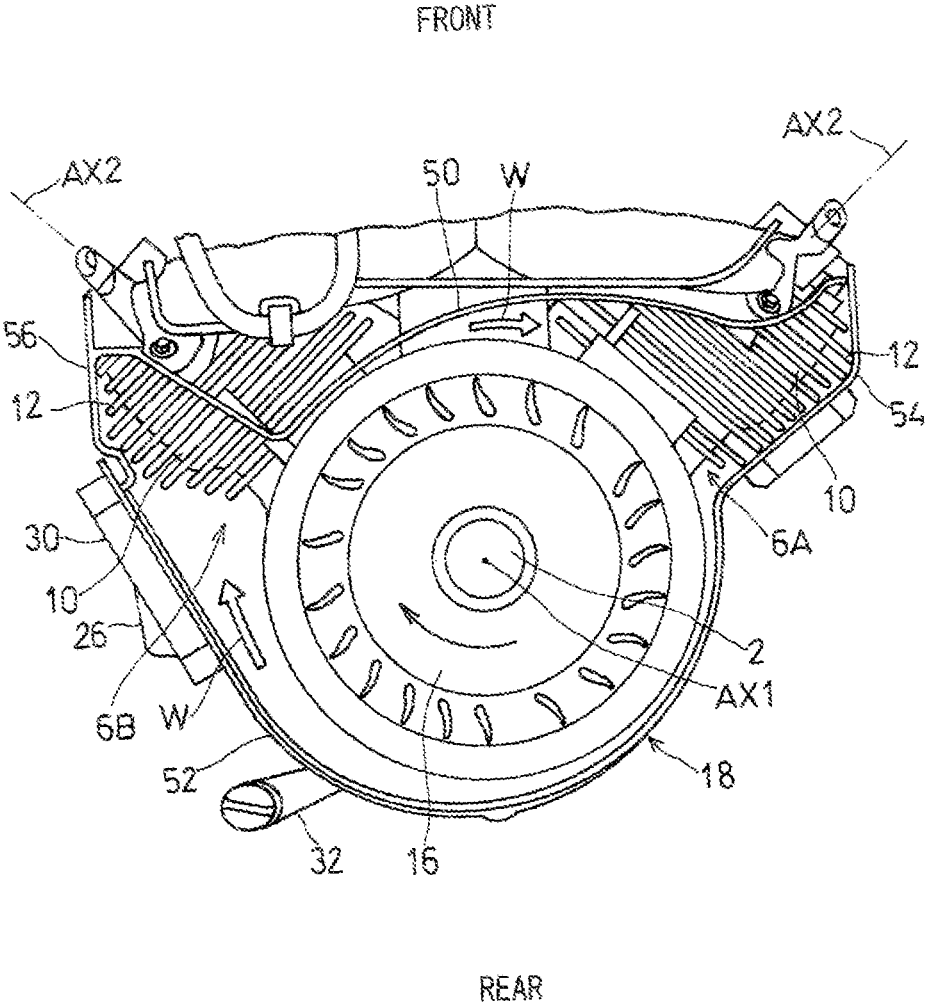
FIG. 8 is a plan view showing an inside of the engine.

Specifically, as shown in FIG. 8, the cooling air W guided to an outer peripheral part of the fan housing 18 flows along the fan housing 18, so that the cooling air W is collected. The collected cooling air W passes through passages defined adjacent to the cylinders 6A. 6B to flow toward the cooling fins 12 of the cylinders 6A, 6B. A first guide part 50 and a second guide part 52 are formed on the outer peripheral part of the fan housing 18. The first guide part 50 is a guide which supplies the collected cooling air W to the first cylinder 6A. The second guide part 52 is a guide which supplies the collected cooling air W to the second cylinder 6B.

Figure 3:
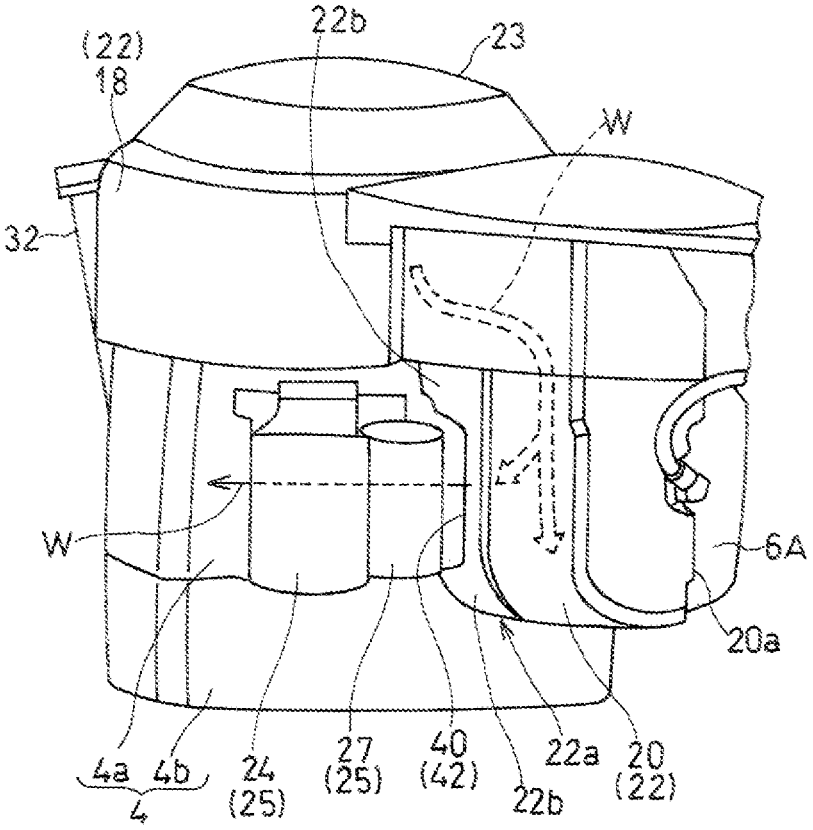
FIG. 3 is a side view of the engine as viewed in a direction of arrow III of FIG. 1.

Further, a shroud 20 as shown in FIG. 3 is attached to the crankcase 4 and the cylinders 6A, 6B. The shroud 20 is made of, for example, a resin. The material of the shroud 20, however, is not limited to a resin. The shroud 20 is disposed below the fan housing 18 and is connected to the fan housing 18. In the present embodiment, each of the cylinders 6A, 6B is provided with a shroud 20. That is, there are two shrouds in total for the first cylinder 6A and the second cylinder 6B. The shrouds 20 cover the cylinders 6A, 6B from the rear and from outside in the widthwise direction. Further, the shrouds 20 partly cover lower parts of the cylinders 6A, 6B.

In other words, each of the shrouds 20 is arranged apart from a corresponding one of the cylinders 6A, 6B on one side of that cylinder 6A, 6B with respect to the cylinder axis AX2. In the present embodiment, each shroud 20 covers a part of a corresponding cylinder 6A, 6B on a side opposite to a space defined between the V-shaped banks. The shrouds 20 and the fan housing 18 are connected one above the other so as to close a gap between them. Specifically, a lower end portion of the fan housing 18 is overlapped with upper end portions of the shrouds 20.

Figure 7:
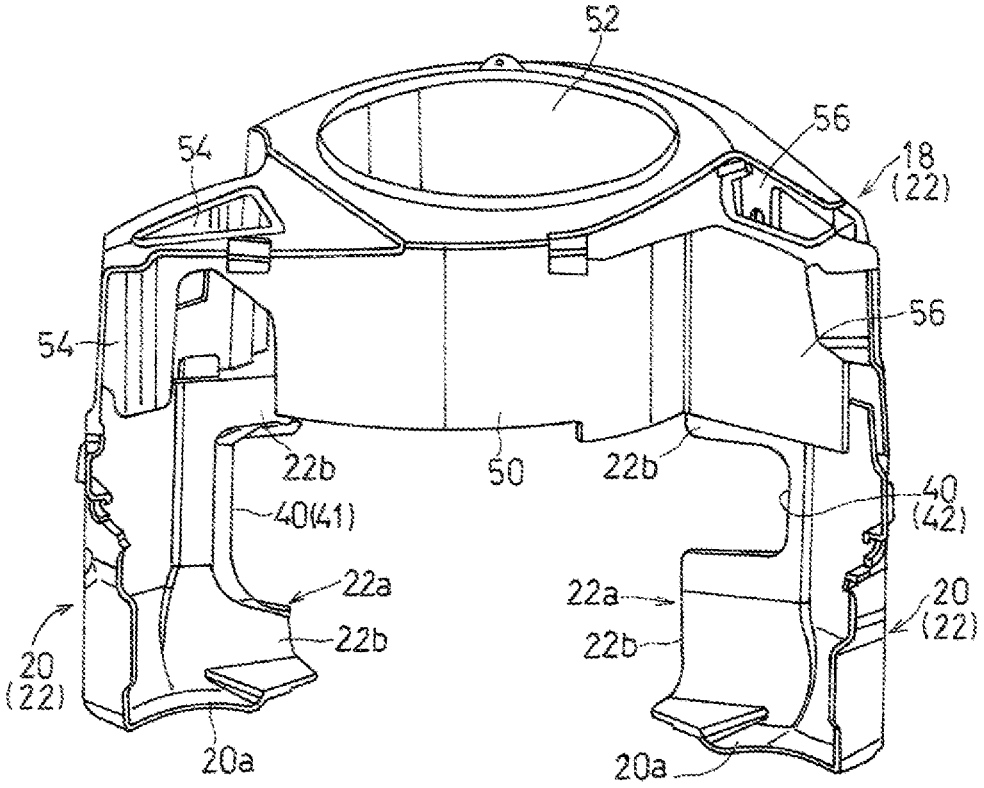
FIG. 7 is a front view of a cover of the engine.

Each shroud 20 covers outside of a corresponding cylinder head 10 in the widthwise direction and covers a part of a tip end surface of that cylinder head 10 from the rear. Each shroud 20 has a substantially L-shaped cross section in a plane perpendicular to a cylinder axis AX2 as shown in FIG. 7. That is, each shroud 20 is arranged apart from a part of a lower surface of a corresponding cylinder 6A, 6B, besides the outer lateral surface of that cylinder in the vehicle widthwise direction. The shrouds 20 include middle openings in parts thereof closer to base end portions of the cylinders 6A, 6B. The shrouds 20 include blocking parts 22*b*, which will be described later, adjacent to the middle openings in the parts thereof closer to the base end portions of the cylinders 6A, 6B.

The shrouds 20 guide the cooling air W which has been guided by the fan housing 18 to the cylinders 6A, 6B. In particular, the cooling air W flowing circumferentially along the inner surface of the fan housing 18 flows downward along the shrouds 20 to be guided to the cylinders 6A, 6B.

As shown in FIG. 8, the first cylinder 6A is located downstream in the flow direction of the cooling air W flowing along the first guide part 50. More specifically, the cooling air W collected in the first guide part 50 is blocked by a first blocking part 54 of the fan housing 18 to be guided toward the first cylinder 6A located below. The second cylinder 6B is located downstream in the flow direction of the cooling air W flowing along the second guide part 52. More specifically, the cooling air W collected in the second guide part 52 is blocked by a second blocking part 56 of the fan housing 18 to be guided toward the cylinder 6B located below. The shrouds 20 prevent the cooling air W guided downward from the fan housing 18 from greatly deviating from the cylinders 6A, 6B. The cooling air W comes into contact with the cooling fins 12 of the cylinders 6A, 6B to take heat from the cylinders 6A, 6B and thereby cool the cylinders 6A, 6B.

The cooling air W after cooling the cylinders 6A, 6B flows out from exit openings 20*a* defined in lower parts of the shrouds 20. That is, the fan housing 18 and the shrouds 20 constitute a cover 22 which guides the cooling air W generated by the cooling fan 16 to the outer surfaces of the cylinders 6A, 6B. The exit openings 20*a* are located below the cylinders 6A, 6B.

In the present embodiment, the fan housing 18 and the shrouds 20 are separate members. That is to say, the cover 22 includes one fan housing 18 and two shrouds 20, 20. The fan housing 18 is removably attached to the crankcase 4 and the cylinders 6A, 6B by use of a plurality of fastening members, and the shrouds 20 are removably attached to the crankcase 4 and the cylinders 6A, 6B by use of a plurality of fastening members. The fan housing 18 and the shrouds 20 may be jointly fastened to the crankcase 4 or to the cylinders 6A, 6B at one or more points.

A screen cover 23 is attached to an upper side of the fan housing 18 as shown in FIG. 2. The screen cover 23 covers the screen 17 from above and is fixed to the fan housing 18. When the cooling fan 16 draws foreign objects having a certain size or larger, the screen cover 23 prevents the foreign objects from entering the fan housing 18.

FIG. 3 is a side view of the engine as viewed in a direction of arrow III of FIG. 1. As shown in FIG. 3, a starting device, which is a type of engine accessory 25, is attached to the outer surface of the crankcase 4. The starting device includes a starter motor 24 and a starter coil 27. The starting device is arranged with a gap from the outer surface of the crankcase 4 in a radial direction of the rotation axis AX1. The starter motor 24 is operable to cause the crankshaft 2 to rotate when the engine is started. The starter coil 27 is a device which supplies a starting current to the starter motor 24 the engine is started. The starter motor 24 is removably attached to the outer lateral surface of the crankcase 4 on the side closer to the first cylinder.

The starting device is arranged with a gap from but close to the base end portion of the first cylinder 6A at which the cylinder is connected to the crankcase 4. The starting device is arranged opposite from the cylinder 6A with respect to the shroud 20. That is, the starting device is arranged at a shorter radial distance about the rotation axis AX1 than that of the cylinder 6A. In the present embodiment, the starting device is located opposite to the space defined between the V-shaped banks of the two cylinders 6A, 6B. The shroud 20 includes the middle opening in an area facing the starting device. In other words, the starting device is arranged adjacent to the middle opening.

Figure 4:
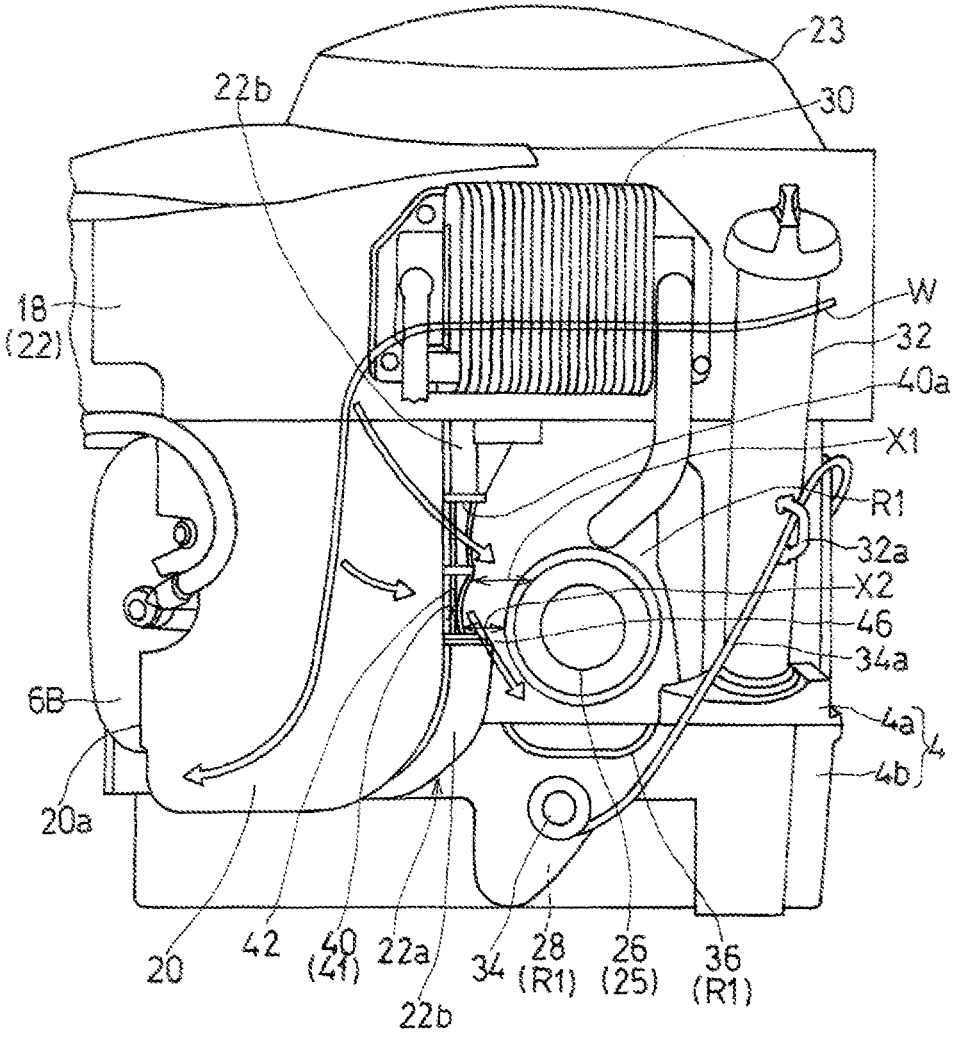
FIG. 4 is a side view of the engine as viewed in a direction of arrow IV of FIG. 1.

FIG. 4 is a side view of the engine as viewed in a direction of arrow IV of FIG. 1. As shown in FIG. 4, an oil filter 26, which is a type of the engine accessory 25, is attached to the outer surface of the crankcase 4. The oil filter 26 is made of, for example, a metal such as steel. The oil filter 26 filters engine oil for lubrication, which is a type of circulating liquid. The circulating liquid is not limited to engine oil for lubrication and may be, for example, engine oil for cooling. In the present embodiment, the same circulating liquid is used as lubrication fluid and cooling fluid. An oil storage part 28 which is filled with the engine oil is located in an area below the oil filter 26 in an inner space of the crankcase 4, namely, in an inner area of the case cover 4*b* in this example.

When the engine E is started, a non-illustrated oil pump is driven in conjunction with the crankshaft 2 to pump up the oil in the oil storage part 28. The oil pumped up by the oil pump is filtered through the oil filter 26 and then is cooled by the oil cooler 30 located above the oil filter 26. The cooled oil is supplied to a to-be-lubricated part or a to-be-cooled part of the engine E before the oil is returned to the oil storage part 28.

The oil filler 32 is attached to the outer surface of the crankcase 4 at a position above the oil storage part 28 and behind the oil filter 26. The oil filler 32 has an oil filler port for filling the oil storage part 28 with the engine oil. A hydraulic pressure sensor 34 is attached to the outer surface of the crankcase 4 at a position below the oil filter 26. The hydraulic pressure sensor 34 detects a pressure of the engine oil to be supplied to the oil filter 26.

A harness 34*a* of the hydraulic pressure sensor 34 extends diagonally upward to the rear from the hydraulic pressure sensor 34 and is engaged with a harness restriction part 32*a* on the oil filler 32. The harness restriction part 32*a* in the present embodiment is a U-shaped bar member and is integrated with the filler 32 made of a resin by mold shaping. The harness restriction part 32*a* restricts movement of the harness 34*a* to prevent the harness 34*a* from interfering with the oil filter 26. Since the oil filter 26 receives the engine oil before the engine oil is cooled by the oil cooler 30, the oil filter 26 tends to have high surface temperature due to the engine oil at relatively high temperature. For this reason, it is not desirable that the harness comes into contact with the oil filter. The shape of the harness restriction part 32*a* and the production method therefor are not limited to those of the present example. In addition, the harness restriction part 32*a* may be omitted.

An oil receiver 36 is arranged below the oil filter 26 on the outer surface of the crankcase 4. The oil receiver 36 protrudes from the outer surface of the crankcase 4 so as to receive oil falling from the oil filter 26 during maintenance. The oil receiver 36 in the present embodiment is inseparable from the crankcase 4. In the present embodiment, the oil receiver 36 is arranged between the oil filter 26 and the hydraulic pressure sensor 34 with respect to the up-and-down direction. That is, the oil receiver 36 is arranged above the hydraulic pressure sensor 34 and below the oil filter 26.

The oil filter 26 is removably attached to the outer surface of the crankcase 4 on the side of the second cylinder 6B. The oil filter 26 is arranged with a gap from but close to the base end portion of the second cylinder 611 at which the cylinder is connected to the crankcase 4. The oil filter 26 is arranged opposite from the cylinder 61 with respect to the shroud 20. That is, the oil filter 26 is arranged at a shorter radial distance about the rotation axis AX1 than that of the cylinder 6B. In the present embodiment, the oil filter 26 is located opposite to the space defined between the V-shaped banks of the two cylinders 6A, 6B. The shroud 20 includes the middle opening in an area facing the oil filter 26. In other words, the oil filter 26 is arranged adjacent to the middle opening.

As described above, the shrouds 20 include opening parts 40 where the middle openings are defined, the middle openings allowing a portion of the cooling air W to flow toward the outer surface of the crankcase 4. In the present embodiment, the opening parts 40 are located in parts of the cover 22 where the cooling air W flows downward (i.e., in the direction of the crank axis AX1). Specifically, the opening parts 40 are located in lower parts of the shrouds 20 with respect to the fan housing 18.

The opening parts 40 are defined in parts of the shrouds 20 at positions closer to the crankshaft 2 than the cylinders 6A, 6B. That is, the opening parts are defined in rear parts of the shrouds. In other words, the opening parts 40 are defined in parts of the shroud 20 so as to face, in a circumferential direction about the rotation axis AX1, the outer parts of the base end portions of the cylinders 6A, 6B in the widthwise direction.

The cover 22 or the shrouds 20 in the present embodiment include facing walls 22*a* which are located adjacent to the crankcase 4 and face the cylinders 6A, 6B. In the present embodiment, each facing wall 22*a* has a major surface facing in the circumferential direction of the crankshaft 2, and a longitudinal direction of the facing wall extends in the axial direction AX1 of the crankshaft 2, i.e., the up-and-down direction.

In other words, the facing walls 22*a* are shaped so as to partition the cylinders 6A, 6B from the crankcase 4. The facing walls 22*a* are located closer to the rotation axis AX1 of the crankshaft 2 than the cylinders 6A, 6B. In the present embodiment, the facing walls 22*a* are arranged so as to face the cooling fins 12 of the cylinders 6A, 6B. The facing walls 22*a* are arranged rearward of rear parts of the cooling fins 12 of the cylinders 6A, 6B with gaps thereto.

The opening parts 40 are defined in the facing walls 22*a*. The opening parts 40 are rectangular cut portions in the facing walls 22*a*. In the present embodiment, the opening parts 40 are located in middle parts of the facing walls 22*a* in the up-and-down direction, with the rest of the facing walls 22*a* extending above and below the opening parts. That is, the parts of each facing wall 22*a* above and below the opening part 40 form the blocking parts 22*b* which prevent the cooling air W from flowing out of the cover 22. In other words, each facing wall 22*a* includes the upper blocking part 22*b*, the opening part 40, and the lower blocking part 22*b* arranged adjacently in the up-and-down direction, i.e., the flow direction of the cooling air W.

In the present embodiment, the blocking parts 22*b* are provided so as to reduce gaps with respect to the crankcase 4, as compared with gaps in the opening parts 40. The blocking parts 22*b* may be shaped so as to be in contact with the crankcase 2 or the fan housing 18.

In this way, the facing walls 22*a* include, except for the areas of the blocking parts 22*b*, the opening parts 40 adjacent to the blocking parts in the flow direction of the cooling air W at least in the downstream areas of the blocking parts 22*b*. This makes it easy to increase the flow speed of the cooling air W flowing from the opening parts 40 to the crankcase 4, as compared with the case where the cover 22 has a uniform gap. That is, having been prevented from flowing out by the blocking parts 22*b*, the cooling air W flows out through the opening parts 40, so that the flow speed and/or flow rate of the cooling air W can be easily increased.

In addition, the blocking parts 22*b* can limit the size increase of the opening parts 40. This makes it easy to adjust the flow rate of the cooling air W flowing out through the exit openings 20*a* and the opening parts 40. Specifically, this makes it easy to adjust the amount of the cooling air W guided to the cooling fins 12 of the cylinders 6A. 6B before passing through the exit openings 20*a* and the amount of the cooling air W passing through the opening parts 40 to be blown toward the outer surface of the crankcase 4.

In the present embodiment, each of the pair of shrouds 20 includes one opening part 40. However, the arrangement and the number of the opening parts 40 are not limited to those of this example. Only one of the shrouds 20 may have an opening part 40. Alternatively, one shroud 20 may have a plurality of opening parts 40.

The cooling air W flowing out through the opening parts 40, for example, flows on the outer surface of the crankcase 4 away from the cylinders 6A, 6B along the circumferential direction of the crankshaft 2. In other words, the cooling air W flowing out through the opening parts 40 flows on the outer surface of the crankcase 4 in the horizontal direction away from the cylinders 6A, 6B. In addition, the cooling air W from the opening parts 40 flows toward to-be-cooled parts R1 such as the engine accessory 25, an area around the engine accessory, and a gap between the engine accessory 25 and the case main body 4*a*. The cooling air W from the opening parts 40 may pass through a gap between the cover 22 and the engine accessory 25 to be guided to the to-be-cooled parts R1. The to-be-cooled parts R1 are located, for example, away from the cooling fan 16 with respect to the cylinder axes AX2 on the outer surface of the crankcase 4.

The to-be-cooled parts R1 of the crankcase 4 include, specifically, the outer surface of the crankcase 4 adjacent to the cylinders 6A, 6B. More specifically, the to-be-cooled parts R1 include areas of the crankcase 4 which are located away from the cylinders 6A. 6B in directions perpendicular to the axis AX1 of the crankshaft 2 passing through the cylinders 6A, 6B. The to-be-cooled parts R1 may include, for example, areas of case outer surfaces overlapping the axis AX1 of the crankshaft 2 and/or areas adjacent to the axis AX1 of the crankshaft 2 in a side view of the engine B.

The to-be-cooled parts R1 include, for example, areas of the crankcase 4 which overlap the cylinders 6A, 6B in the axial direction AX1 of the crankshaft 2. In a case of the engine in which the crankshaft 2 extends in the vertical direction as in the present embodiment, the to-be-cooled parts R1 include areas of the crankcase 4 away from the cylinders 6A, 6B in the horizontal direction and areas of the crankcase 4 overlapping the cylinders 6A,6B in a height direction of the cylinders. The to-be-cooled parts R1 may be located, for example, in middle areas of the crankcase 4 in the up-and-down direction.

The to-be-cooled parts R1 of the crankcase 4 may include at least either the engine accessory 25 or the area around the engine accessory. Herein, the engine accessory 25 is a device, cooling of which contribute to lowering the temperature of the engine. The to-be-cooled parts R1 of the crankcase 4 may include parts of the crankcase 2 which are located between the shrouds 20 and the engine accessory 25. Such an engine accessory 25 includes, for example, the oil filter 26 as shown in FIG. 4.

The to-be-cooled parts R1 of the crankcase 4 may include a gap between the engine accessory 25 and the crankcase 4. In this case, cooling of the engine accessory 25 itself does not contribute much to lowering the temperature of the engine. However, the cooling air W flows into the gap between the engine accessory 25 and the crankcase 4 to have a higher flow speed, so that the outer surface of the crankcase 4 is cooled. Such an engine accessory 25 may include, for example, the starting device of FIG. 3.

The to-be-cooled parts R1 of the crankcase 4 may include parts which store the circulating liquid moving through the respective parts of the engine. The cooled circulating liquid moves through the respective parts of the engine so as to suppress temperature increase in the engine. Such parts may include, for example, the oil storage part 28 for the lubrication engine oil of FIG. 4.

Further, the to-be-cooled parts R1 of the crankcase 4 include, for example, parts of the outer surface of the crankcase 4 which have great influence on the cooling effect. Specifically, the to-be-cooled parts include protruding parts or recessed parts on the outer surface of the crankcase 4 which thus have increased surface areas. Flow of the cooling air to the parts with large surface areas can provide increased contact areas with the cooling air, so that temperature rise in the engine can be effectively suppressed. Such parts may include, for example, the oil receiver 36 of FIG. 4.

A longitudinal direction of each opening part 40 extends in the axial direction of the crankshaft 2, i.e., the up-and-down direction in the present embodiment. In the present embodiment, each opening part 40 is a rectangular opening that is formed as a cutout at an edge part of a shroud 20 and is elongated in the up-and-down direction. The shape of each opening part 40 is not limited to such a rectangular shape.

In the present embodiment, each opening part 40 has an upstream end 40*a* located closer to the cooling fan 16 than, i.e., located above the to-be-cooled parts R1 of the crankcase 4. This shape and arrangement of the opening parts 40 allow a portion of the cooling air W which is guided downward by the shrouds 20 to be smoothly guided through the opening parts 40 toward the to-be-cooled parts R1.

Each opening part 40 has a smaller opening area S1 than an opening area S2 of each exit opening 20*a* of FIG. 2 through which the cooling air W having cooled the cylinder 6 flows out (S1<S2). In other words, a greater amount of the cooling air W is supplied to the cylinders 6 than to the to-be-cooled parts R1 of the crankcase 4. That is, the cylinders 6 are the main cooling target, and the to-be-cooled parts R1 of the crankcase 4 are the subsidiary cooling target.

Each opening part 40 may include, at an opening edge portion 40*b* thereof, a guide portion 42 protruding in a thickness direction of the shroud 20. The guide portion 42 may extend in the horizontal direction. The guide portion 42 may have a length in the horizontal direction larger than a thickness dimension, in the horizontal direction, of the guide portion 42 excluding the shroud 20. The guide portion 42 is shaped such that the cooling air W from the opening parts 40 flows toward the to-be-cooled parts R1. In the present embodiment, the guide portion 42 is inseparable from the shroud 20. The shape of the guide portion 42 is not limited to that of the present embodiment. The guide portion 42 may be located over the entirety of or only a part of the opening edge portion 40*b* of the opening part 40. The guide portion 42 may be omitted.

Hereinafter, the opening parts 40 and the to-be-cooled parts R1 of the present embodiment will be described in details.

As shown in FIG. 4, the shroud 20 on the side of the second cylinder 4B is provided with a first middle opening 41 facing the oil filter 26. The cooling air W from the first middle opening 41 flows toward the oil filter 26 and parts of the outer surface of the crankcase 4 around the oil filter 26. That is, the first middle opening 41 constitutes a part of the opening part 40 which allows a portion of the cooling air W to flow toward the outer surface of the crankcase 4.

Figure 5:
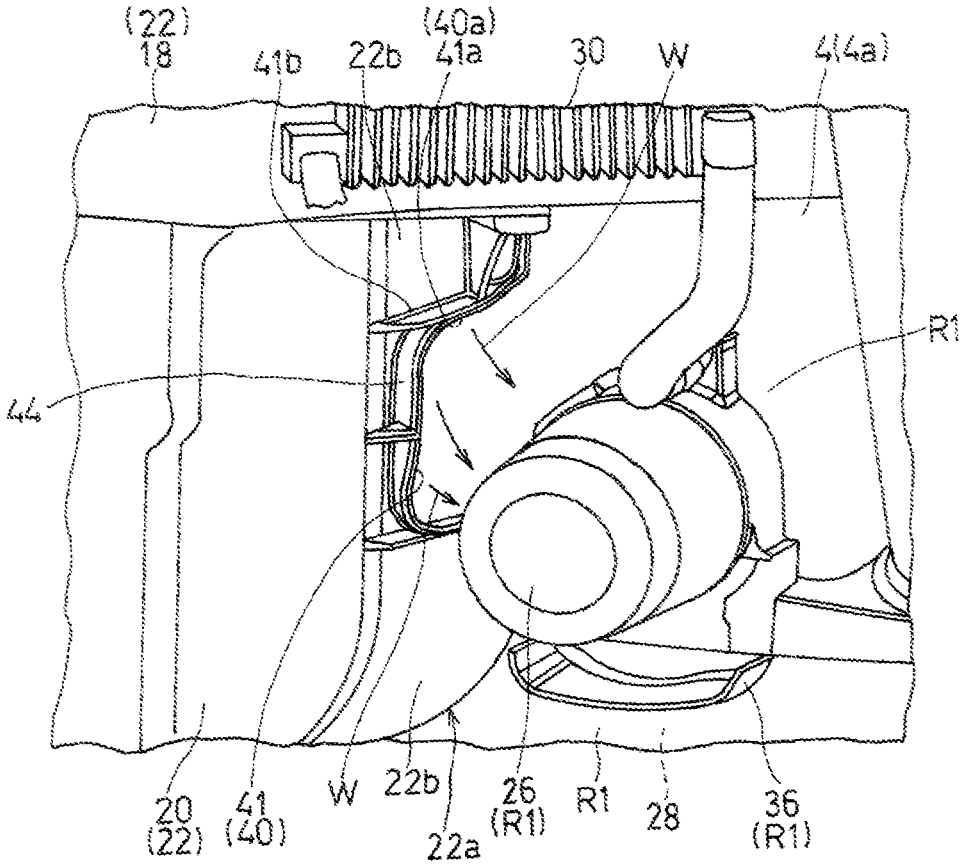
FIG. 5 is a perspective view showing an area around an opening part of the engine in an enlarged manner.

The cooling air W from the first middle opening 41 flows along the circumferential direction of the crankshaft 2. The first middle opening 41 is a rectangular cutout having a longitudinal direction extending in the up-and-down direction, and an upper end 41*a* of the first middle opening 41 as shown in FIG. 5 is located closer to the cooling fan 16 than, i.e. located above the upper end of the oil filter 26. The first middle opening 41 has a smaller opening area than the opening area of the exit opening 20*a*.

The cooling air W from the first middle opening 41 further passes through a gap between the oil filter 26 and the shroud 20 to flow toward the oil receiver 36 below the oil filter 26 and toward an outer surface of the oil storage part 28 around the oil receiver. In other words, the cooling air W from the first middle opening 41 collides with the oil receiver 36 to be diffused on the neighboring outer surface of the oil storage part 28 and surrounding areas. Since the oil receiver 36 has an increased surface area as it protrudes from the outer surface of the crankcase 4, the oil receiver serves as cooling fins. A portion of the cooling air W having collided with the oil receiver 36 is reflected by the oil receiver 36 to flow toward the oil filter 26 located above the oil receiver 36.

The cooling air W from the first middle opening 41 passes through a gap 46 (FIG. 4) between the shroud 20 and the oil filter 26 to flow toward the oil receiver 36 and the storage part 28. The oil filter 26 is disposed so as to be closer to the shroud 20 from the upper end of the oil filter to the middle part of the oil filter in the up-and-down direction. In particular, there is a smaller distance X2 between the shroud 20 and the middle part of the oil filter 26 in the up-and-down direction than a distance X1 between the shroud 20 and the upper end of the oil filter 26. Thus, the flow of the cooling air W toward the oil receiver 36 and the storage part 28 is narrowed in the gap 46, specifically, in an area between the shroud 20 and the middle part of the oil filter 26 in the up-and-down direction to have a higher flow speed. That is, the gap 46 between the shroud 20 and the oil filter 26 constitutes a throttle part 46 where a flow path of the cooling air W narrows.

Thus, the above-mentioned to-be-cooled parts R1 on the side of the second cylinder in the present embodiment include the oil filter 26, the parts of the outer surface of the crankcase 4 around the oil filter 26, the oil receiver 36 and the storage part 28.

The first middle opening 41 includes, at an opening edge portion 41*b* thereof, a guide portion 44 protruding in the thickness direction of the shroud 20. In the present embodiment, the guide portion 44 extends over an entire periphery of the opening edge portion 41 of the first middle opening 41. The guide portion 44 in the present embodiment is inseparable from the shroud 20. In addition, the guide portion 44 in the present embodiment includes a rib 45. The rib 45 reinforces the opening edge portion 41*b* of the first middle opening 41.

Figure 6:
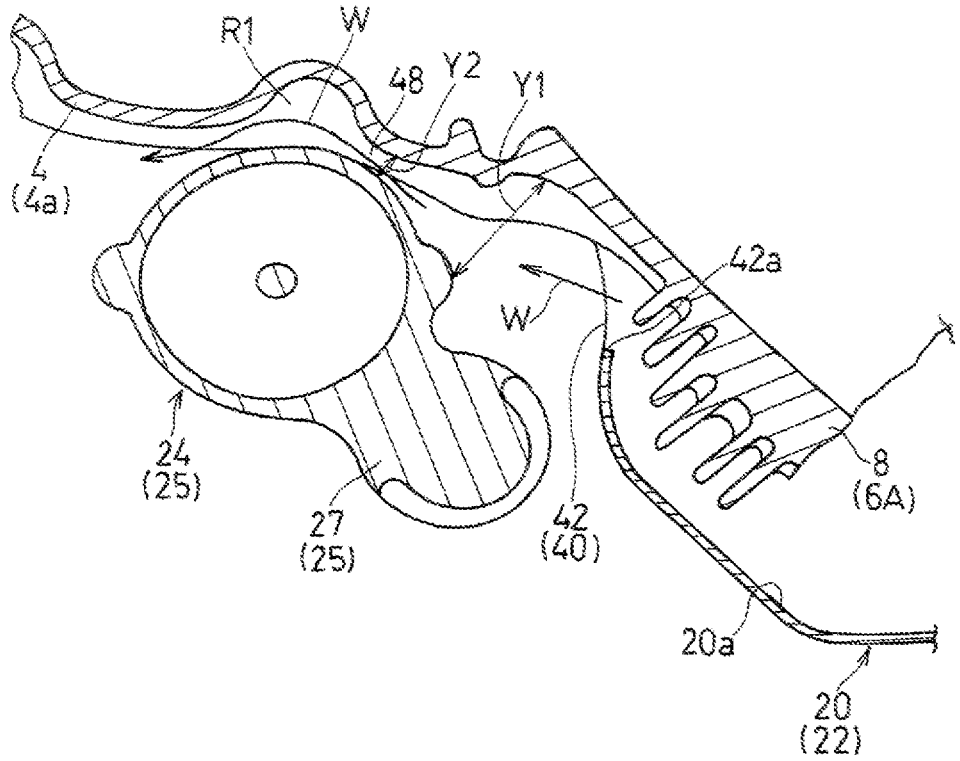
FIG. 6 is a section view showing an area around another opening part of the engine in an enlarged manner.

As shown in FIG. 3, the shroud 20 on the side of the first cylinder 6A is provided with a second middle opening 42 facing a gap 48 between the crankcase 4 and the starter motor 24. The cooling air W from the second middle opening 42 passes through the gap 48 between the crankcase 4 and the starting device to flow on the outer surface of the crankcase 4 as shown in FIG. 6. That is, the second middle opening 42 constitutes a part of the opening part 40 which allows a portion of the cooling air W to flow toward the outer surface of the crankcase 4.

As shown in FIG. 3, the cooling air W from the second middle opening 42 flows along the circumferential direction of the crankshaft 2. The second middle opening 42 is a rectangular cutout having a longitudinal direction extending in the up-and-down direction. The second middle opening 42 has a smaller opening area than the area of the exit opening 20*a*. The gap 48 between the crankcase 4 and the starting device as shown in FIG. 6 narrows as it extends away from the second middle opening 42. In particular, there is a smaller distance Y2 between the crankcase 4 and a middle part of the starter motor 24 than a distance Y1 between the crankcase 4 and a part of the starter motor 24 closest to the second middle opening 42. As used herein, a middle part of the starter motor 24 means a part equidistant from a closest part and a most distant part of the starter motor 24 to/from the second middle opening 42.

Specifically, each of the starter motor 24 and the starter coil 27 has a cylindrical shape having an axis extending parallel to the axis AX1 of the crankshaft 2. The cooling air W flowing toward the starting device is deflected by the starting device so as to flow toward the crankcase 4. In this way, the cooling air W having an increased flow speed flows through the gap 48 between the crankcase 4 and the starting device. Thus, the flow of the cooling air W from the second middle opening 42 is narrowed in the gap 48 to have a higher flow speed. That is, the gap 48 between the crankcase 4 and the starter motor 24 constitutes a throttle part 48 where a flow path of the cooling air W narrows. The cooling air W having an increased flow speed collides with the crankcase 4 to facilitate heat exchange with the crankcase 4, so that the temperature rise in the crankcase 4 can be suppressed.

Thus, the above-mentioned to-be-cooled parts R1 on the side of the first cylinder 6A in the present embodiment include the area of the gap 48 between the crankcase 4 and the starter motor 24 on the outer surface of the crankcase 4. The opening edge portion 42*a* of the second middle opening 42 is not provided with the guide portion 44. If necessary, however, the opening edge portion 42*a* of the second middle opening 42 may be provided with a guide portion 44.

The flow of the cooling air W in the present embodiment will be described. When the engine E as shown in FIG. 1 is started to cause the crankshaft 2 to rotate in the direction indicated with arrow R1, the cooling fan 16 rotates in conjunction with the crankshaft 2. When the cooling fan 16 rotates, air A is sucked into the fan housing 18 as cooling air W. The cooling air W is guided by the fan housing 18 and the shrouds 20 to flow downward.

A major part of the cooling air W guided by the fan housing 18 and the shroud 20 is guided to the outer surfaces of the cylinders 6A, 6B to cool the cylinders 6 and is then exhausted from the exit openings 20*a* of the shrouds 20.

A portion of the cooling air W flows from the opening parts 40 toward the outer surface of the crankcase 4. In particular, as shown in FIG. 4, the cooling air W passes through the first middle opening 41 to flow diagonally downward on the outer surface of the crankcase 4 along the circumferential direction of the crankshaft 2. A portion of the cooling air W from the first middle opening 41 flows toward the oil filter 26, and the rest of this cooling air W passes through the gap 46 between the oil filter 26 and the shroud 20 to flow toward the oil receiver 36 and the outer surface of the storage part 28.

Thus, the oil filter 26 and surrounding parts are cooled, and the oil receiver 36 and the outer surface of the oil storage part 28 are also cooled. This results in taking heat from the crankcase 4 and cooling the engine oil which is the circulating liquid. As the cooled engine oil circulates, the engine oil takes heat from the respective parts inside the engine and consequently takes heat from the whole engine.

As shown in FIG. 3, the cooling air W from the second middle opening 42 flows on the outer surface of the crankcase 4 along the circumferential direction of the crankshaft 2. The cooling air W from the second middle opening 42 passes through the gap 48 (FIG. 6) between the crankcase 4 and the starter motor 24 to have an increased flow speed and then flows on the outer surface of the crankcase 4. This facilitates heat exchange between the crankcase 4 and the cooling air W to take heat from the crankcase 4.

According to the above constitution, as shown in FIG. 4, the blocking parts 22*b* of the facing walls 22*a* can prevent the cooling air W from flowing away from the cylinders 6A, 6B and guide the cooling air toward the cylinders 6A, 6B. In addition, thanks to the opening parts 40 defined in the parts of the facing walls 22*a* excluding the blocking parts 22*b*, a portion of the cooling air W passes through the opening parts 40 to flow toward the outer surface of the crankcase 4, so that the part of the cooling air is used for cooling of the crankcase 4. That is, a portion of the cooling air W to be supplied to the cylinders 6A, 6B is distributed to flow on the outer surface of the crankcase 4 through the opening parts 40. This takes heat from the crankcase 4 in addition to the cylinders 6A, 6B, so that temperature rise can be suppressed in the whole engine.

The cooling air W from the opening parts 40 passes through the throttle parts 46, 48 having the narrowing gaps with distance from the opening parts 40. Thus, the flow speed of the cooling air W toward the to-be-cooled parts R1 is increased when it passes through the throttle parts 46, 48 from the opening parts 40, so that the cooling effect can be enhanced. For example, the outer surfaces of the engine accessory 25 and/or the cover 22 can be used to provide the throttle parts 46, 48, so that the throttle part 46, 48 can be formed without using a dedicated structure. This makes it easy to reduce the number of components and to simplify the structure.

Each opening part 40 has the smaller opening area S1 than the opening area S2 of each exit opening 20*a*. Thus, a greater amount of the cooling air is supplied to the cylinders 6A, 6B than an amount of the cooling air distributed to the outer surface of the crankcase 4. Therefore, the cooling effect on the cylinders 6A, 6B is not deteriorated.

The upper end 41*a* of the first middle opening 41 of FIG. 5 is located above the upper end of the oil filter 26. Thus, the cooling air W flowing downward from above along the shroud 20 smoothly flows toward the oil filter 26 as well as the oil receiver 36 and the outer surface of the oil storage part 28 located below the oil filter. In particular, the cooling air W flowing downward from above along the shroud 20 readily flows from the first middle opening 41 toward the oil filter 26, the oil receiver 36 and the oil storage part 28. As a result, improvement in the cooling effect can be expected.

The to-be-cooled parts R1 on the outer surface of the crankcase 4 are located away from the cooling fan 16 with respect to the cylinder axes AX2. This makes it easy to divert a portion of the cooling air W from the cooling fan 16 toward the cylinders 6A, 6B and guide it to the outer surface of the crankcase 4.

The longitudinal direction of each opening part 40 extends in the axial direction AX1 of the crankshaft 2. Thus, the cooling air W from the opening parts 40 flows in a direction perpendicular to the cylinder axes AX2, i.e., flows away from the cylinders 6A, 6B. Therefore, a portion of the cooling air from the cooling fan 16 toward the cylinders 6A, 6B can be easily diverted and guided to the outer surface of the crankcase 4.

The cooling air W from the opening parts 40 flows along the circumferential direction of the crankshaft 2. This makes it easy to increase an area in which the air flows along the crankcase 4, as compared with an area in which the air flows in the axial direction AX1 of the crankshaft 2. As a result, improvement in the cooling effect can be expected.

The opening edge portion 41*b* of the first middle opening 41 is formed with the guide portion 44 protruding in the thickness direction of the opening edge portion. The guide portion 44 reinforces the first middle opening 41 and facilitates generation of the flow of the cooling air W toward the to-be-cooled parts R1 while preventing the cooling air from deviating. As a result, improvement in the cooling effect can be expected.

The harness 34*a* of the hydraulic pressure sensor 34 is engaged with the harness restriction part 32*a* on the oil filler 32. Thus, the harness 34*a* is restricted so as not to move due to the cooling air from the first middle opening 41, so that it is possible to avoid contact of the harness 34*a* with the oil filter 26 at high temperature.

The cooling air W from the first middle opening 41 flows toward the oil storage part 28 which is filled with the engine oil OL in the crankcase 4. That is, the cooling air W from the first middle opening 41 can cool the engine oil in addition to the outer surface of the crankcase 4, and the cooled engine oil is circulated inside the engine. As a result, temperature rise can be suppressed in the whole engine. Cooling of the engine oil improves cooling capability of the engine oil despite use of the existing oil cooler 30, so that the temperature of the engine oil can be lowered without upgrading or modifying the oil cooler 30. As a result, it is possible to prevent degradation of the engine oil and extend the life of the engine oil.

The cooling air W from the first middle opening 41 flows toward the oil filter 26. Thus, the engine oil OL in the oil filter 26 and parts of the crankcase 4 around the oil filter 26 are cooled. As a result, temperature rise can be suppressed in the whole engine.

The cooling air W from the first middle opening 41 also flows toward the oil receiver 36 and collides with the oil receiver 36. Thus, the oil receiver 36 is also cooled, and moreover, heat is taken from the crankcase 4. As a result, temperature rise can be suppressed in the whole engine.

As shown in FIG. 3, the cooling air W from the second middle opening 42 passes through the gap 48 (FIG. 6) between the crankcase 4 and the starter motor 24 to flow on the outer surface of the crankcase 4. Thus, heat is taken from the crankcase 4, and as a result, temperature rise can be suppressed in the whole engine.

As shown in FIG. 6, the gap 48 between the crankcase 4 and the starter motor 24 is shaped such that the gap 48 narrows with distance from the second middle opening 42. Thus, the flow speed of the cooling air W flowing on the outer surface of the crankcase 4 is increased when the air passes through the gap 48, so that improvement in the cooling effect can be expected. As a result, temperature rise can be suppressed in the whole engine.

The fan housing 18 and the shrouds 20 as shown in FIG. 4 are separate members, and the opening parts 40 are defined in the shrouds 20. This makes it possible to apply the cooling structure according to the present disclosure to an existing engine by only changing the shrouds 20. For example, even where an existing engine is modified to improve its performance (for example, by decreasing the engine displacement and/or increasing the output), so that the engine has an increased thermal efficiency (heat generation amount), the engine can be made ready for implementing the cooling structure by changing the shrouds 20, without taking countermeasures against heat such as increasing the volume of the oil cooler 30.

The engine E is a V-type two-cylinder engine, and the opening parts 40 include the first middle opening 41 facing the oil filter 26 and the second middle opening 42 facing the gap 48 between the crankcase 4 and the starter motor 24. According to this constitution, the cooling air W flows from the two middle openings 41, 42 over a wide area on the surface of the crankcase to take heat from the opposite side surfaces of the crankcase 4. As a result, temperature rise can be suppressed in the whole engine.

Since the crankshaft 2 of the engine E extends in the vertical direction, the cooling air W from the opening parts 40 flows downward from above. Thus, the cooling air W smoothly flows toward the to-be-cooled parts R1, so that improvement in the cooling effect can be expected.

The present disclosure is not limited to the above-described embodiment, and various additions, modifications, or deletions may be made without departing from the scope of the present disclosure. For example, although there are two middle openings 41, 42 in the above embodiment, only one of the first and second middle openings 41,42 may be provided as the opening part 40. Further, in order to enhance the cooling effect, cooling fins may be arranged at locations where the cooling air W collides (especially, on the outer surface of the crankcase 4, the outer surface of the oil filter 26, etc.) to increase the surface area. This can enhance the cooling effect on the engine.

Although, in the above embodiment, the axis of the crankshaft 2 extends in the vertical direction, the arrangement is not limited to this. For example, the axis of the crankshaft 2 may extends in the horizontal direction. Alternatively, the engine may be mounted in such an attitude that the axis of the crankshaft 2 extends in the vertical direction and the engine is angularly displaced about the axis of the crankshaft 2, as compared with that in the above embodiment. For example, the engine may be mounted in such an attitude that the engine is angularly displaced by 90° about the axis of the crankshaft 2, as compared with that in the above embodiment. Further, the engine may not necessarily be a V-type engine and may include a single cylinder. The engine according to the present disclosure may be used as a drive source for other applications than a riding lawn mower, such as a drive source for power generation.

Although, in the above embodiment, the oil filter, the starter motor, and the starter coil are mentioned as the engine accessories to which the cooling air flowing out through the middle openings is guided, the engine accessories are not limited to these. For example, the engine accessories to which the cooling air flowing out through the middle openings is guided may include other engine accessories arranged on the outer surface of the crankcase. Specifically, the engine accessories may include pipes which are filled with the circulating liquid. By guiding the cooling air to such pipes to cool the circulating liquid, the whole engine can be cooled.

The engine accessories may include a harness for an electrical component or a regulator. These engine accessories define the flow path for narrowing the flow of the cooling air through the opening parts of the shrouds so as to guide the cooling air at an increased flow speed to the outer surface of the crankcase and thereby cool the outer surface of the crankcase, as in the above embodiment.

In the above embodiment, each opening part which defines the middle opening has a rectangular shape. The shape, however, may be other shape than a rectangular shape. For example, each opening part may have an elliptical shape or may be provided with a plurality of slit-like openings arranged next to one another. The opening part may be provided with a louver which serves as guide plates for defining a jet direction.

In the above embodiment, the starting device includes both of the starter motor and the starter coil. The starting device may be constructed such that the cooling air is guided to either the starter motor or the starter coil. Accordingly, such variants are included within the scope of the present disclosure.

What is claimed is:

1. An engine comprising:

a crankcase which supports a crankshaft of the engine;

a cylinder which is connected to the crankcase and protrudes from the crankcase in a cylinder axis direction;

a cooling fan which generates cooling air; and a cover which guides the cooling air toward the cylinder, wherein the cover includes a facing wall located adjacent to the crankcase and facing the cylinder, and the facing wall includes: an opening part which allows a portion of the cooling air to flow toward an outer surface of the crankcase; and a blocking part which is arranged next to the opening part in a flow direction of the cooling air to prevent the cooling air from flowing out of the cover, the engine is a V-type two-cylinder engine including:

an oil filter which is attached to the outer surface of the crankcase on a side of one cylinder and filters engine oil, and a starting device which is attached to the outer surface of the crankcase a side of the other cylinder and causes the crankshaft to rotate, and the opening part includes a first middle opening facing the oil filter and a second middle opening facing a gap between the crankcase and the starter motor.

2. An engine comprising:

a crankcase which supports a crankshaft of the engine;

a cylinder which is connected to the crankcase and protrudes from the crankcase in a cylinder axis direction;

a cooling fan which generates cooling air; and a cover which guides the cooling air toward the cylinder, the cylinder being disposed inside of the cover, wherein the cover includes a facing wall located adjacent to the crankcase and facing the cylinder so as to partition the cylinder from the crankcase, and the facing wall includes: an opening part which allows a portion of the cooling air to flow toward the outside of the cover along an outer surface of the crankcase; and a blocking part which is arranged next to the opening part in a flow direction of the cooling air to prevent the cooling air from flowing out of the cover.

3. The engine as claimed in claim 2, wherein a flow path of the cooling air from the opening part includes a throttle part having a narrowing gap with distance from the opening part.

4. The engine as claimed in claim 3, further comprising an engine accessory attached to the outer surface of the crankcase, wherein the engine accessory defines the narrowing gap in the flow path of the cooling air from the opening part.

5. The engine as claimed in claim 3, wherein an outer surface of the cover defines the narrowing gap in the flow path of the cooling air from the opening part.

6. The engine as claimed in claim 2, further comprising an engine accessory attached to the outer surface of the crankcase, wherein the opening part allows a portion of the cooling air to flow toward an area around the engine accessory and a gap between the engine accessory and the crankcase.

7. The engine as claimed in claim 2, wherein the opening part has a smaller opening area than an opening area of an exit opening through which the cooling air having cooled the cylinder flows out.

8. The engine as claimed in claim 2, wherein the opening part has an upstream end in a flow direction of the cooling air, the upstream end located closer to the cooling fan than a to-be-cooled part of the crankcase.

9. The engine as claimed in claim 8, wherein the to-be-cooled part is located away from the cooling fan with respect to a cylinder axis.

10. The engine as claimed in claim 2, wherein the cooling air is taken into the opening part in an axial direction of the crankshaft, and the opening part has a longitudinal direction extending in the axial direction of the crankshaft.

11. The engine as claimed in claim 2, wherein the opening part includes, at an opening edge portion thereof, a guide portion protruding in a thickness direction of the cover.

12. The engine as claimed in claim 2, wherein the cooling air from the opening part flows toward a storage part which is filled with circulating liquid in the crankcase.

13. The engine as claimed in claim 2, further comprising an oil filter which is attached to the outer surface of the crankcase and filters engine oil, wherein the cooling air from the opening part flows toward the oil filter.

14. The engine as claimed in claim 13, further comprising an oil receiver which protrudes from the outer surface of the crankcase and is arranged below the oil filter, wherein the cooling air from the opening part collides with the oil receiver.

15. The engine as claimed in claim 2, further comprising a starting device which is attached to the outer surface of the crankcase and causes the crankshaft to rotate, wherein the cooling air from the opening part flows toward a gap between the crankcase and the starting device.

16. The engine as claimed in claim 15, wherein the gap between the crankcase and the starting device includes a throttle part having a narrowing gap with distance from the second opening.

17. The engine as claimed in claim 2, wherein the cover includes: a fan housing which radially covers the cooling fan, and a shroud which guides cooling air having been guided in the fan housing to the cylinder, the fan housing and the shroud are separate members, and the opening part is defined in the shroud.

18. An engine comprising:

a crankcase which supports a crankshaft of the engine;

a cylinder which is connected to the crankcase and protrudes from the crankcase in a cylinder axis direction, the cylinder having a cooling fin on an outer periphery thereof;

a to-be-cooled part defined on an outer surface of the crankcase and located adjacent to the cooling fin with respect to a direction perpendicular to the cylinder axis direction;

a cooling fan which is connected to the crankshaft and generates cooling air; and a cover which covers the cylinder and guides the cooling air toward the cooling fin, wherein the cover includes a facing wall located adjacent to the crankcase and facing the cylinder fin, and the facing wall includes: an opening part which allows a portion of the cooling air to flow toward the to-be-cooled part outside the cover in a direction perpendicular to a crankshaft axis; and a blocking part which is arranged so as to be adjacent to the opening part and prevents a remaining portion of the cooling air from flowing out of the facing wall.

19. The engine as claimed in claim 18, wherein the cover further includes, in addition to the opening part, an exit opening through which the cooling air after cooling the cylinder flows out.

20. The engine as claimed in claim 2, wherein an upper end of the opening part in an axial direction of the crankshaft is closer to the cooling fan than a lower end of the cylinder in the axial direction of the crankshaft.

* * * * *